United States Patent [19]

Fuchs

[11] Patent Number: 4,628,604

[45] Date of Patent: Dec. 16, 1986

[54] HANDHELD CIRCULAR SAW WITH BASEPLATE

[75] Inventor: Rudolf Fuchs, Neuhausen, Fed. Rep. of Germany

[73] Assignee: Karl M. Reich Maschinenfabrik GmbH, Nuertingen, Fed. Rep. of Germany

[21] Appl. No.: 703,223

[22] Filed: Feb. 19, 1985

[30] Foreign Application Priority Data

Feb. 10, 1984 [DE] Fed. Rep. of Germany ..... 3404754

[51] Int. Cl.[4] ..... B27B 9/02

[52] U.S. Cl. ..... 30/390

[58] Field of Search ..... 30/290, 293, 388, 390, 30/391, 392

[56] References Cited

U.S. PATENT DOCUMENTS 1,848,330 3/1932 Emmons ..... 30/391 X 3,547,166 12/1970 Dudek ..... 30/390 X

*Primary Examiner*—Douglas D. Watts

*Attorney, Agent, or Firm*—W. G. Fasse; D. H. Kane, Jr.

[57] ABSTRACT

In a portable circular saw, the baseplate (8) is attached to the motor housing (1) in a manner such that the baseplate may be locked into position or slidably adjusted perpendicular to the saw blade (2) as desired. These features permit using the saw as a normal portable circular saw with a sufficiently protruding baseplate, and after a simple adjustment, also as a silhouette kerf saw with a minimally protruding baseplate. Thus, one tool serves both of these purposes.

3 Claims, 3 Drawing Figures

HANDHELD CIRCULAR SAW WITH BASEPLATE

FIELD OF THE INVENTION

The invention relates to a handheld or portable circular saw with a baseplate, to which is attached a protective blade cover and a motor housing with a driven saw blade.

DESCRIPTION OF THE PRIOR ART

In prior art portable circular saws with baseplates, the motor housing and the saw blade may be tilted or displaced perpendicularly to the plane of the baseplate, in order to adjust the cutting depth. In order to provide a secure support, the baseplate projects a sufficient distance beyond the saw blade, also on the side opposite the motor housing, whereby it is not possible to saw any closer to a wall than is permitted by the portion of the baseplate projecting beyond the saw blade opposite the saw housing.

On the other hand, special portable circular saws, so-called silhouette kerf saws, have become known. With these saws it is possible to make cuts which closely follow, for instance, a wall contour. For example, the end pieces of the individual boards of a wooden ceiling (or floor) may be sawed off in a parallel plane close to the adjacent wall, after the boards have been securely attached. However, in such saws the baseplate may protrude only slightly beyond the saw blade on the side opposite of the motor housing. Guidance of such kerf saws is achieved along the adjacent wall by means of a dually guided longitudinal stop or guide fence. Normal conventional portable circular saws are thus not suitable for silhouette kerf sawing. Similarly, conventional silhouette kerf saws are not well suited for sawing purposes other than silhouette kerf sawing.

OBJECTS OF THE INVENTION

In view of the above it is the aim of the invention to achieve the following objects singly or in combination:

to provide a portable circular saw which may be used for normal sawing operations as well as for silhouette kerf sawing;

to retain all the advantages, such as adjustment capabilities and a full sized baseplate, of a circular saw when the saw according to the invention is used in a normal sawing mode;

to allow a complete conversion of a large baseplate circular saw to and from a silhouette kerf saw and vice versa by means of a simple adjustment; and to tilt the baseplate relative to the plane of the saw blade and to arrest the baseplate in tilted positions for making angular cuts in defined positions of the baseplate relative to the saw blade plane.

SUMMARY OF THE INVENTION

The above objectives have been achieved in a portable circular saw according to the invention, in which the baseplate is attached to the motor housing in a manner such that the baseplate may be slidably displaced perpendicularly to the saw blade, and then may be secured in a desired position, whereby the baseplate may project outside the saw blade opposite the saw housing for normal use and may be pulled back to an adjustable extent for kerf sawing.

Due to the slidable baseplate, an otherwise normal portable circular saw becomes a multi-purpose saw. The saw operator now only needs a single tool for normal sawing as well as for silhouette kerf sawing. Advantages in production also arise, since greater numbers of the same saw may now be produced.

The portable circular saw according to the invention may be used as a silhouette kerf saw and has the added advantages of a normal portable circular saw, such as a secure surface contact support, and an angular adjustment of the baseplate relative to the plane of the saw blade. This angular adjustment is preferably possible only when the baseplate is adjusted to a position in which it protrudes furthest beyond the saw blade opposite the housing. The present saw operates completely as a normal circular saw or as a kerf saw, or as an angular saw. Thus, the saw motor housing may be tilted about two axes and secured with respect to the baseplate, in order to adjust both the depth of cut and the angle of cut. In the silhouette kerf saw mode, the baseplate is preferably adjusted so that its guide edge is substantially flush with the blade guard. However, if an additional circular guide slot is provided to merge into the right-hand end of the longitudinal guide slot, then the baseplate could be tilted even in its leftmost position.

The use of the baseplate as a longitudinal stop or guide fence according to the invention avoids the necessity of a separate guide fence, allowing further cost economy in producing the saw.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
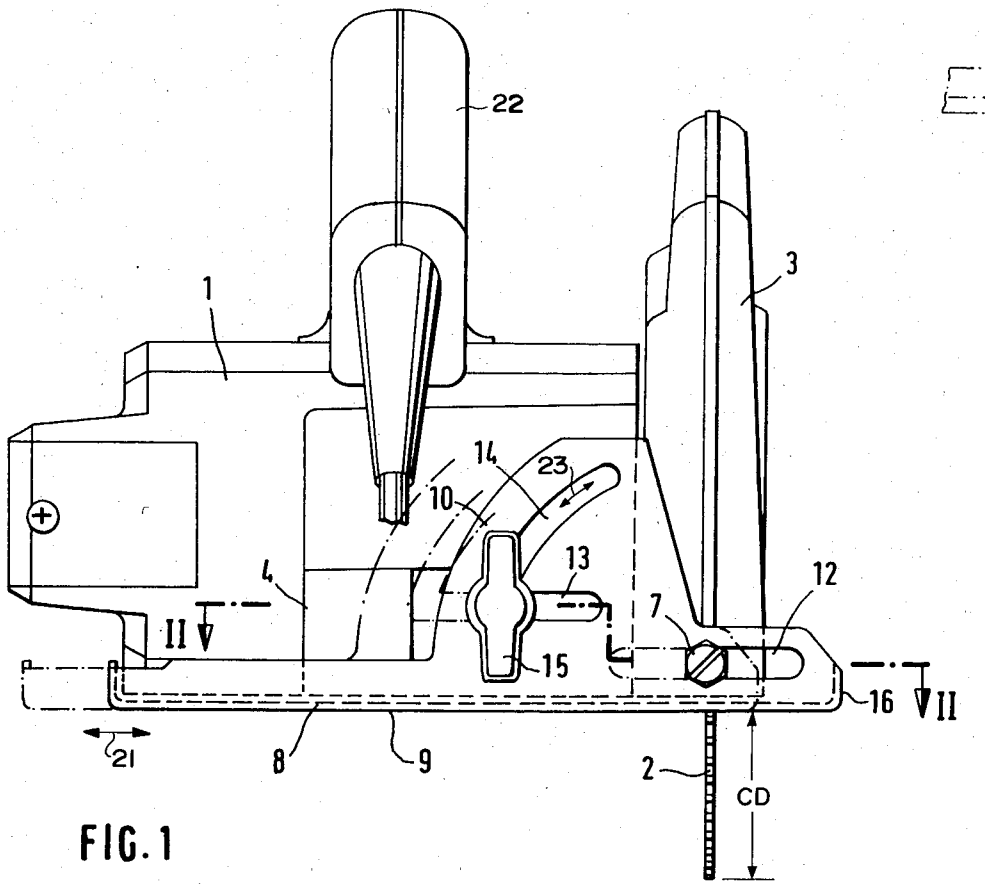
FIG. 1 shows a portable circular saw with a slidably adjustable baseplate, as seen by an operator intending to hold the saw, for example, in his right hand.
Figure 2:
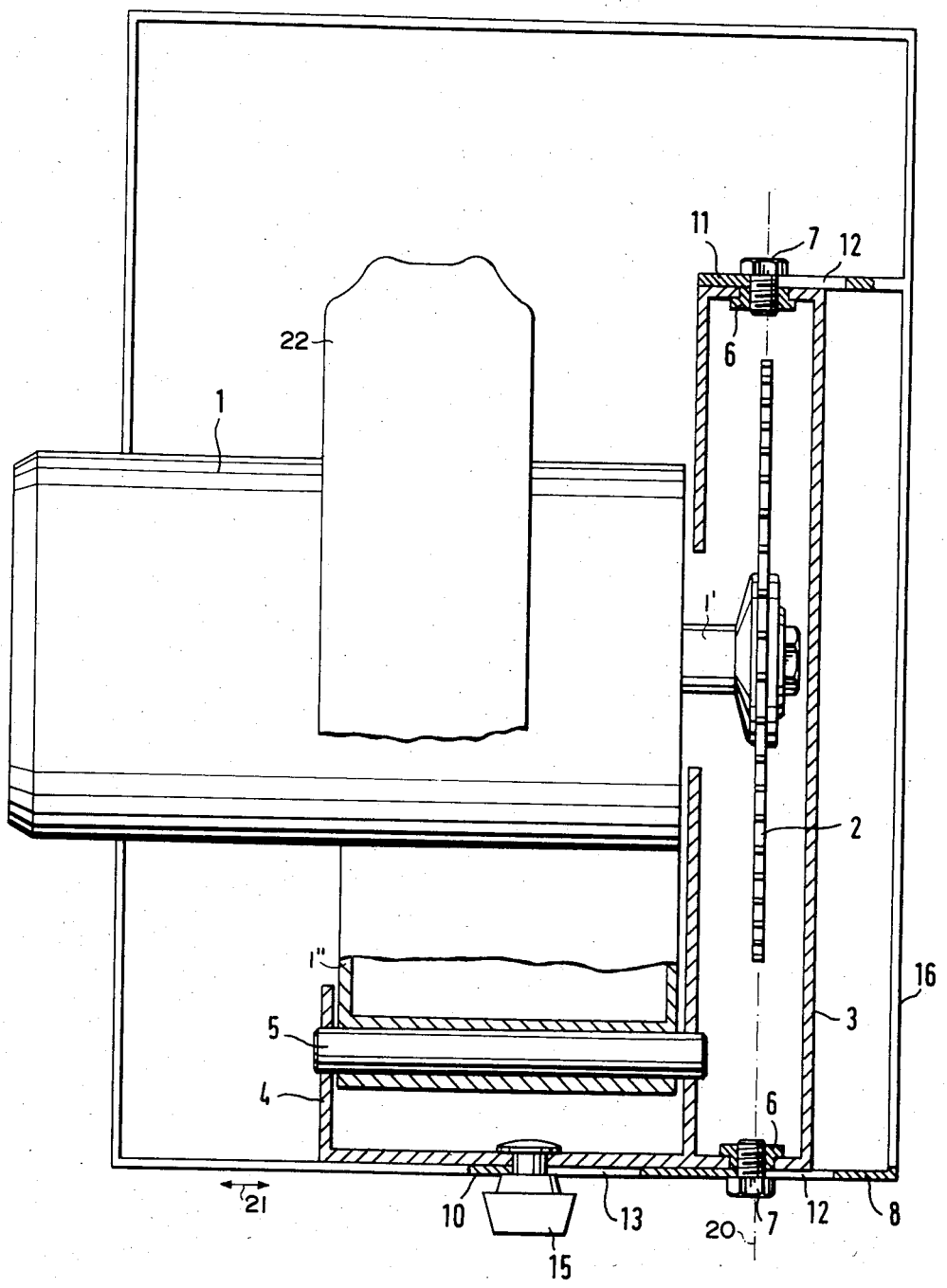
FIG. 2 is a partial section along the section line II—II in FIG. 1.

The portable circular saw shown in FIGS. 1 and 2 comprises a motor housing 1 with a handle 22 and a saw blade 2 connected to a motor shaft 1' of an electric motor in the housing 1. The saw blade 2 is enclosed, above a base plate 8, by a protective blade guard or cover 3, which is connected as a one piece structure to a support bracket 4. The motor housing 1 with its extension 1" and the saw blade 2 are tiltably journalled in a known manner on an axle 5 mounted in a wall of the protective cover 3 and in the support bracket 4 for adjusting the cutting depth CD as is conventional in this type of saw. The protective cover 3 further comprises threaded bushings 6, into which locking screws 7 are screwed. The baseplate 8 is attached to the protective cover 3 by means of these locking screws 7. Tilt brackets 10 and 11 arranged perpendicular to the contact surface 9 of the baseplate 8 are each provided with a respective longitudinal slot 12 through which the locking screws 7 pass for locking the baseplate 8 to the cover 3 in the adjusted position. Since the threaded bushings 6 are in alignment with each other they define a tilting axis 20 for tilting the motor housing 1 together with the protective cover 3 about the axis 20 defined by the bushings 6, in order to carry out angled cuts. For this purpose, a further longitudinal slot 13 and an arc-shaped, preferably circular, tilting slot 14 are provided in the tilting bracket 10. A locking screw 15 is so located that it engages either of the two slots 13 or 14 so that respectively either a sliding adjustment of the baseplate 8 in the direction of the arrow 21 or a tilting motion of the motor housing 1 in the direction of the arrow 23 is possible. The arc-shaped slot 14 is so located at the left-hand end of the slot 13 that the tilting for angular cuts is possible only when the baseplate 8 is in the full line, right-hand position shown in FIG. 1. However, several slots 14 extending in parallel to each other could be provided, if desired. In the preferred embodiment the tilting is possible when the saw is used as a normal circular saw, i.e. when the baseplate 8 is in its rightmost end position as seen in FIG. 1. When the saw is used as a silhouette kerf saw, the baseplate 8 is in its leftmost end position shown by dash-dotted lines in FIG. 1, whereby the locking screw 15 engages the longitudinal slot 13 and thereby prevents a tipping or angling of the saw blade.

The baseplate 8 further comprises a fence or guide surface 16 extending in parallel to the saw blade 2. This surface 16 serves as a longitudinal stop or guide for the silhouette kerf sawing mode.

Figure 3:
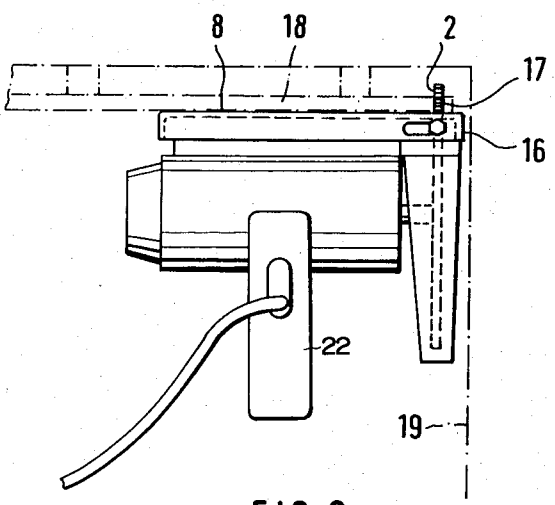
FIG. 3 shows a circular saw as in FIG. 1, when used as a silhouette kerf saw.

FIG. 3 shows the portable circular saw according to the invention, used as a silhouette kerf saw, whereby the endpieces 17 of the boards 18 attached to a ceiling are to be sawed off along a straight line in parallel to and close to the wall 19. In order to achieve this, the baseplate 8 is adjusted fully toward the saw blade 2, and the guide surface 16 serves as a longitudinal guide along the wall 19.

Although the invention has been described with reference to specific example embodiments, it is to be understood, that it is intended to cover all modifications and equivalents within the scope of the appended claims.

I claim:

1. A portable circular saw, comprising a baseplate, a protective blade guard, and a motor in a motor housing for driving a saw blade, means attaching said baseplate to said motor housing for adjustably sliding said baseplate in a direction perpendicular to a plane defined by said saw blade, means for locking said baseplate in a desired position adjustment, whereby said saw can cut kerfs in saw positions close to a wall extending in parallel to said saw blade, wherein said attaching means comprise tilt bracket means arranged perpendicularly to a contact surface of said baseplate, said tilt bracket means having longitudinal slot means for permitting said protective blade guard and said motor housing connected thereto to slide relative to said baseplate, wherein said locking means comprise at least one releasable locking member extending through said longitudinal slot means, wherein said tilt bracket means comprise arc-shaped slot means extending in at least one of said tilt bracket means to merge into the respective longitudinal slot means, and wherein said locking screw is located for also sliding in said arc-shaped tilting slot means in said tilt bracket means for achieving blade angling, and for sliding in one of said longitudinal slot means in said tilt bracket means to allow adjustment of said baseplate into a silhouette kerf sawing mode position.

2. The circular saw of claim 1, wherein said baseplate comprises a guide surface parallel to said saw blade.

3. The circular saw of claim 1, wherein said arc-shaped slot means are so located relative to said longitudinal slot means that said blade angling is possible only when said baseplate projects beyond said saw blade in a normal sawing mode.

* * * * *